US010816010B2

(12) United States Patent
Horng et al.

(10) Patent No.: US 10,816,010 B2
(45) Date of Patent: Oct. 27, 2020

(54) CEILING FAN

(71) Applicant: Sunonwealth Electric Machine Industry Co., Ltd., Kaohsiung (TW)

(72) Inventors: Alex Horng, Kaohsiung (TW); Tso-Kuo Yin, Kaohsiung (TW); Kun-Ta Yang, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 112 days.

(21) Appl. No.: 16/145,343

(22) Filed: Sep. 28, 2018

(65) Prior Publication Data

US 2019/0211840 A1 Jul. 11, 2019

(30) Foreign Application Priority Data

Jan. 11, 2018 (TW) ..... 107101104 A

(51) Int. Cl.
*F04D 29/34* (2006.01)
*F04D 25/08* (2006.01)
(Continued)

(52) U.S. Cl.
CPC ..... *F04D 29/34* (2013.01); *F04D 19/002* (2013.01); *F04D 25/088* (2013.01); *F04D 29/668* (2013.01)

(58) Field of Classification Search
CPC ..... F04D 29/34; F04D 29/668; F04D 29/388; F04D 29/666; F04D 25/088; F04D 19/002
(Continued)

(56) References Cited

U.S. PATENT DOCUMENTS 3,681,911 A 8/1972 Humphries
7,284,960 B2 10/2007 Aynsley
(Continued)

FOREIGN PATENT DOCUMENTS

CN 2905983 Y 5/2007
CN 103410777 A 11/2013
(Continued)

OTHER PUBLICATIONS 1-in × 6-ft Foam Plumbing Tubular Pipe Insulation. (n.d.). Retrieved Jun. 26, 2016, from https://web.archive.org/web/20160626205540/https://www.lowes.com/pd/Frost-King-1-in-x-6-ft-Foam-Plumbing-Tubular-Pipe-Insulation/3133247 (Year: 2016).*
(Continued)

*Primary Examiner* — David E Sosnowski
*Assistant Examiner* — Hakeem M Abdellaoui
(74) *Attorney, Agent, or Firm* — Alan D. Kamrath; Karin L. Williams; Mayer & Williams PC

(57) ABSTRACT

A ceiling fan includes an axle, a hub, a plurality of blades, a plurality of connecting members, and a plurality of protective sleeves. The hub is rotatably coupled with the axle. The plurality of blades is coupled with the hub. Each of the plurality of blades has a first end and a second end. The first end is coupled with the hub. Each of the plurality of blades has a channel intercommunicating the first end with the second end. The plurality of connecting members is respectively received in the channels of the plurality of blades. Each of the plurality of connecting members has an end coupled with the hub, as well as another end coupled with the second end of the each of the plurality of blades. The plurality of protective sleeves respectively envelopes the plurality of connecting members.

9 Claims, 6 Drawing Sheets

(51) Int. Cl.
*F04D 19/00* (2006.01)
*F04D 29/66* (2006.01)

(58) Field of Classification Search
USPC ..... 416/210 R
See application file for complete search history.

(56) References Cited

U.S. PATENT DOCUMENTS

| | | | | |
|---|---|---|---|---|
| 8,070,447 | B2 | 12/2011 | Itou et al. | |
| 8,328,521 | B2 | 12/2012 | Itou et al. | |
| 8,770,937 | B2 * | 7/2014 | Fizer | F04D 25/088 416/210 R |
| 9,347,462 | B2 | 5/2016 | Fizer et al. | |
| 2008/0014090 | A1 * | 1/2008 | Aynsley | F04D 29/34 416/204 R |
| 2010/0104461 | A1 * | 4/2010 | Smith | F01D 5/141 417/423.1 |
| 2013/0336790 | A1 * | 12/2013 | Wortman | F01D 5/141 416/170 R |

FOREIGN PATENT DOCUMENTS

| | | | |
|---|---|---|---|
| CN | 106015058 | A | 10/2016 |
| TW | M553371 | U | 12/2017 |

OTHER PUBLICATIONS 1-in × 6-ft Foam Plumbing Tubular Pipe Insulation., From https://www.lowes.com/pd/Frost-King-1-in-x-6-ft-Foam-Plumbing-Tubular-Pipe-Insulation/3133247 (Year: 2016).*

* cited by examiner

CEILING FAN

CROSS REFERENCE TO RELATED APPLICATION

The application claims the benefit of Taiwan application serial No. 107101104, filed on Jan. 11, 2018, and the subject matter of which is incorporated herein by reference.

BACKGROUND OF THE INVENTION

1. Field of the Invention

The present invention generally relates to an apparatus for driving the air and, more particularly, to a ceiling fan.

2. Description of the Related Art

Ceiling fans have been widely used as they do not occupy the user's space and have an excellent air-driving effect. A conventional ceiling fan includes a stator, a rotor and a plurality of blades. The stator has an axle to which the rotor is rotatably coupled. The rotor includes a hub with a fixation plate. The plurality of blades is fixed to the fixation plate of the rotor. A steel rope is connected between the fixation plate and the plurality of blades. The rotor drives the blades to rotate based on the rotation relative to the axle of the stator. As a result, the blades cause the air to flow. An embodiment of such a ceiling fan is seen in China Patent No. 106015058A entitled "safety ceiling fan."

However, both the blades and the steel rope comprise rigid material, which inevitably causes vibration during the rotation of the ceiling fan. The vibration force causes collision between the steel rope and the blades, which not only results in damage to the structure but also leads to large noise that is annoying to the user. Furthermore, although there is a steel rope connected between the fixation plate and the plurality of blades, if the blades break somewhere around the tips thereof, the broken pieces of the tips will fall down or fly apart. This can hurt the surrounding people or cause damage to the articles around. In addition, the presence of the steel rope on the surfaces of the blades results in an unsightly appearance of the ceiling fan.

In light of this, it is necessary to improve the conventional ceiling fans.

SUMMARY OF THE INVENTION

It is therefore the objective of this invention to provide a ceiling fan which reduces the noise, improves the safety in use, and is visually pleasing.

In an aspect, a ceiling fan includes an axle, a hub, a plurality of blades, a plurality of connecting members, and a plurality of protective sleeves. The hub is rotatably coupled with the axle. The plurality of blades is coupled with the hub. Each of the plurality of blades has a first end and a second end. The first end is coupled with the hub. Each of the plurality of blades has a channel intercommunicating the first end with the second end. The plurality of connecting members is respectively received in the channels of the plurality of blades. Each of the plurality of connecting members has an end coupled with the hub, as well as another end coupled with the second end of the each of the plurality of blades. The plurality of protective sleeves respectively envelopes the plurality of connecting members.

Based on this, the ceiling fan according to the invention is provided with the plurality of connecting members respectively in the channels of the plurality of blades. In this regard, each of the plurality of connecting members is connected between the hub and the second end of a respective blade while enveloped by a respective protective sleeve. As a result, the blade will not fall on the ground when the blade breaks or disengages from the hub. Also, the vibration or shaking noise caused by the connecting members resulting from the rotation of the ceiling fan can be reduced, thereby providing a low noise operation. Advantageously, the ceiling fan can serve as an air-driving apparatus which is useful, safe, and visually attractive.

In an example, each of the plurality of connecting members is in a form of a steel rope, a steel cable or a rope. Thus, the structure is simple and the manufacturing and the assembly are convenient, thereby reducing the manufacturing cost and improving the convenience in assembly.

In the example, each of the plurality of blades includes at least one rib in the channel thereof, and the at least one rib is connected between the first end and the second end of the each of the plurality of blades. Thus, the structural strength of the plurality of blades is improved.

In the example, each of the plurality of blades includes two ribs and a block in the channel thereof. The two ribs are aligned with each other in a vertical direction and form a seat at the second end of the each of the plurality of blades. The block is connected to a respective one of the plurality of connecting members and is positioned on the seat. Thus, the connecting member can be securely connected to the second end of the blade.

In the example, each of the plurality of blades includes two limiting members and two limiting holes. The two limiting holes are respectively arranged in a top face and a bottom face of the each of the plurality of blades in the vertical direction. The block has a threaded hole axially aligned with the two limiting holes in the vertical direction. The two limiting members respectively extend through the two limiting holes and are threadedly engaged with the threaded hole. Thus, the engagement between the connecting member and the blade is reinforced.

In the example, each of the plurality of protective sleeves comprises an elastic material or a foam material. Thus, a vibration reduction effect and a noise reduction effect can be provided.

In the example, the hub includes an intermediate member coupled with a top of the hub, and the plurality of blades is coupled with the hub via the intermediate member. Thus, the structural strength is increased and the convenience in assembly is improved.

In the example, a cross section of each of the plurality of protective sleeves is in a form of a loop, and the loop has a receiving hole receiving a respective one of the plurality of connecting members. Thus, each of the plurality of protective sleeves can be coupled with the respective one of the plurality of connecting members more conveniently.

In the example, the loop has a slit whose width is smaller than a diameter of each of the plurality of connecting members. Thus, the convenience in assembly between the protective sleeve and the connecting member is improved.

In the example, the loop is in a form of a circle or a water droplet. Thus, the protective sleeve can properly envelop the connecting member.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
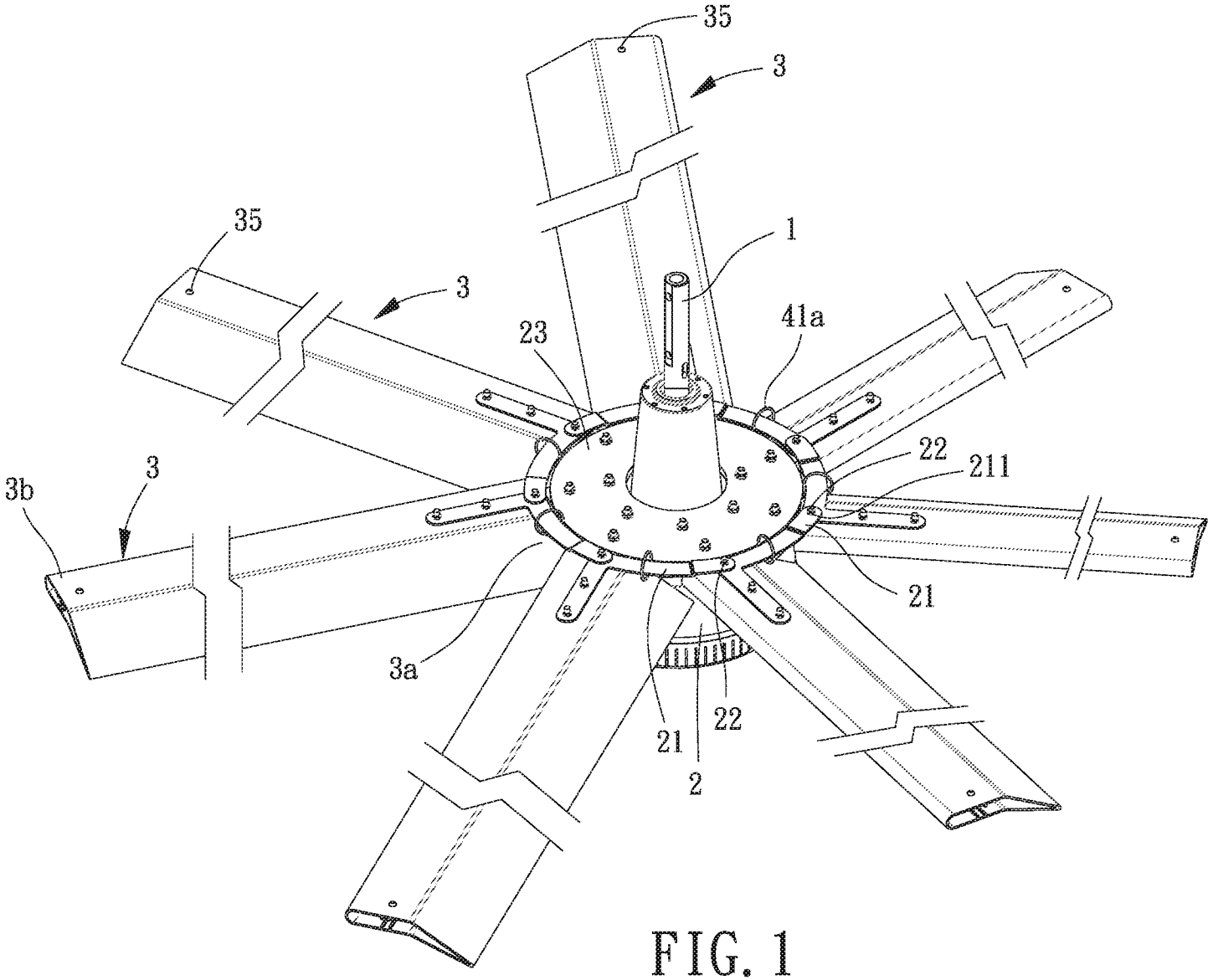
FIG. 1 shows a ceiling fan according to a preferred embodiment of the invention.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
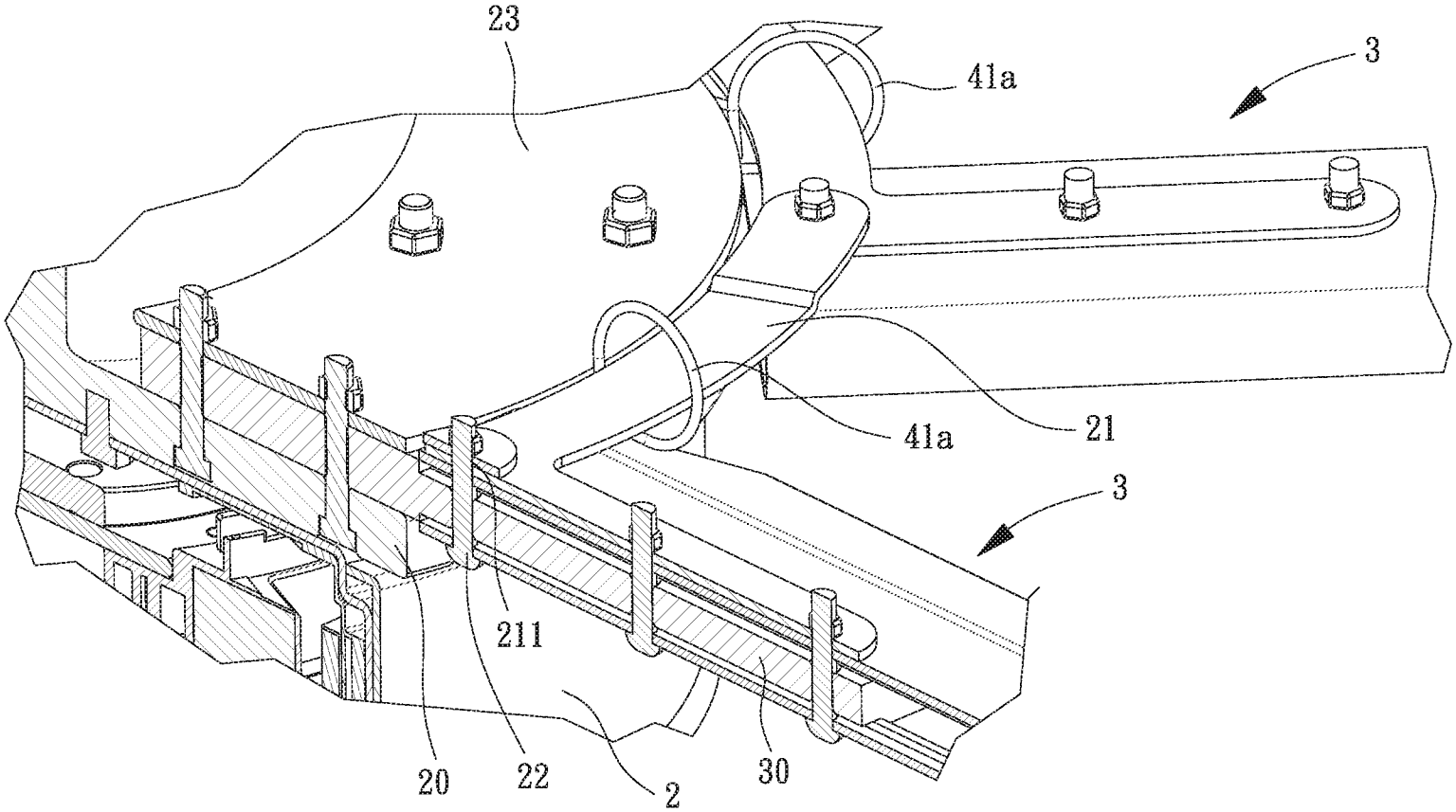
FIG. 2 is a partially enlarged view of the ceiling fan according to the preferred embodiment of the invention.
Figure 3:
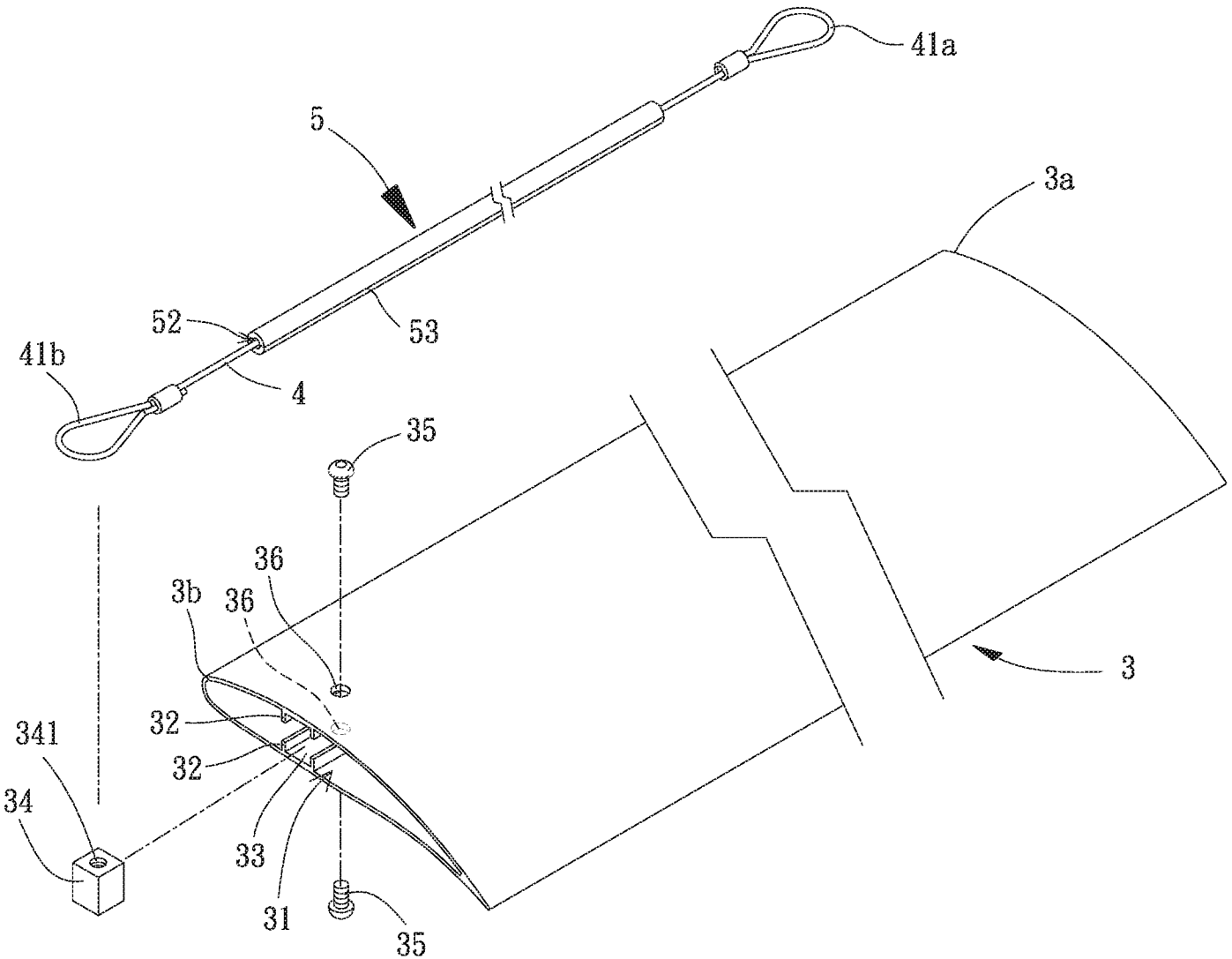
FIG. 3 is an exploded view of the blade, the connecting member and the protective sleeve according to the invention.

FIGS. 1, 2 and 3 show a ceiling fan according to a first embodiment of the invention. The ceiling fan includes an axle 1, a hub 2 rotatably coupled with the axle 1, a plurality of blades 3 coupled with the hub 2, a plurality of connecting members 4 connected between the hub 2 and a respective blade 3, and a plurality of protective sleeves 5 respectively enveloping the plurality of connecting members 4.

Referring to FIG. 1, the axle 1 can be directly or indirectly fixed to a place such as the ceiling.

Referring to FIGS. 1 and 2, the hub 2 is rotatably coupled with the axle 1 and includes an intermediate member 20 coupled with a top of the hub 2. Besides, the hub 2 includes a plurality of engagement members 21 and a plurality of fasteners 22. Each of the plurality of engagement members 21 has a plurality of through-holes 211.

Referring to FIGS. 1, 2 and 3, the plurality of blades 3 is coupled with the hub 2. Specifically, the plurality of blades 3 is coupled with the hub 2 via the intermediate member 20. Each of the plurality of blades 3 has a first end 3*a*, a second end 3*b*, and a channel 31 connecting the first end 3*a* and the second end 3*b* to each other. In a preferred case, each of the plurality of blades 3 includes an assembly unit 30 extending into a respective channel 31. Each of the plurality of fasteners 22 extends through a respective through-hole 211 to fix the corresponding assembly unit 30 in the channel 31 and at the first end 3*a* of the blade 3. The assembly units 30 of the plurality of blades 3 are coupled with the hub 2 via the intermediate member 20. Each assembly unit 30 is located between the intermediate member 20 and a cover plate 23 to improve the convenience in assembly between the plurality of blades 3 and the hub 2.

Referring to FIG. 3, specifically, each of the plurality of blades 3 may include at least one rib 32 in the channel 31. The at least one rib 32 is connected to the first end 3*a* and the second end 3*b* to increase the structural strength of the blade 3.

Referring to FIG. 3, in this embodiment, each of the plurality of blades 3 includes two ribs 32 in the channel 31. The two ribs 32 are aligned with each other in a vertical direction and form a seat 33 at the second end 3*b*. Each of the plurality of blades 3 may include a block 34 connected to the connecting member 4 and positioned on the seat 33. In this arrangement, the connecting member 4 can be securely connected to the second end 3*b* of the blade 3.

The block 34 has a threaded hole 341. Each of the plurality of blades 3 includes two limiting members 35 and two limiting holes 36. The two limiting holes 36 are respectively arranged in the top face and the bottom face of the blade 3 in the vertical direction. The threaded hole 341 is axially aligned with the two limiting holes 36 in the vertical direction. The two limiting members 35 respectively extend through the two limiting holes 36 and are threadedly engaged with the threaded hole 341 to ensure that the connecting member 4 can be securely connected to the second end 3*b* of the blade 3 and does not displace during the rotation of the plurality of blades 3. Thus, the engagement between the connecting member 4 and the blade 3 is reinforced.

Referring to FIGS. 1, 2 and 3, the connecting member 4 is connected between the hub 2 and the corresponding blade 3 and is received in the channel 31 of the blade 3. Each connecting member 4 has an end directly or indirectly connected to the hub 2, as well as another end connected to the second end 3*b* of the blade 3. The connecting member 4 is preferably in the form of a steel rope, a steel cable or a rope which has a simple structure and can be manufactured and assembled conveniently. Thus, the manufacturing cost is reduced and the convenience in assembly is improved.

Figure 4:
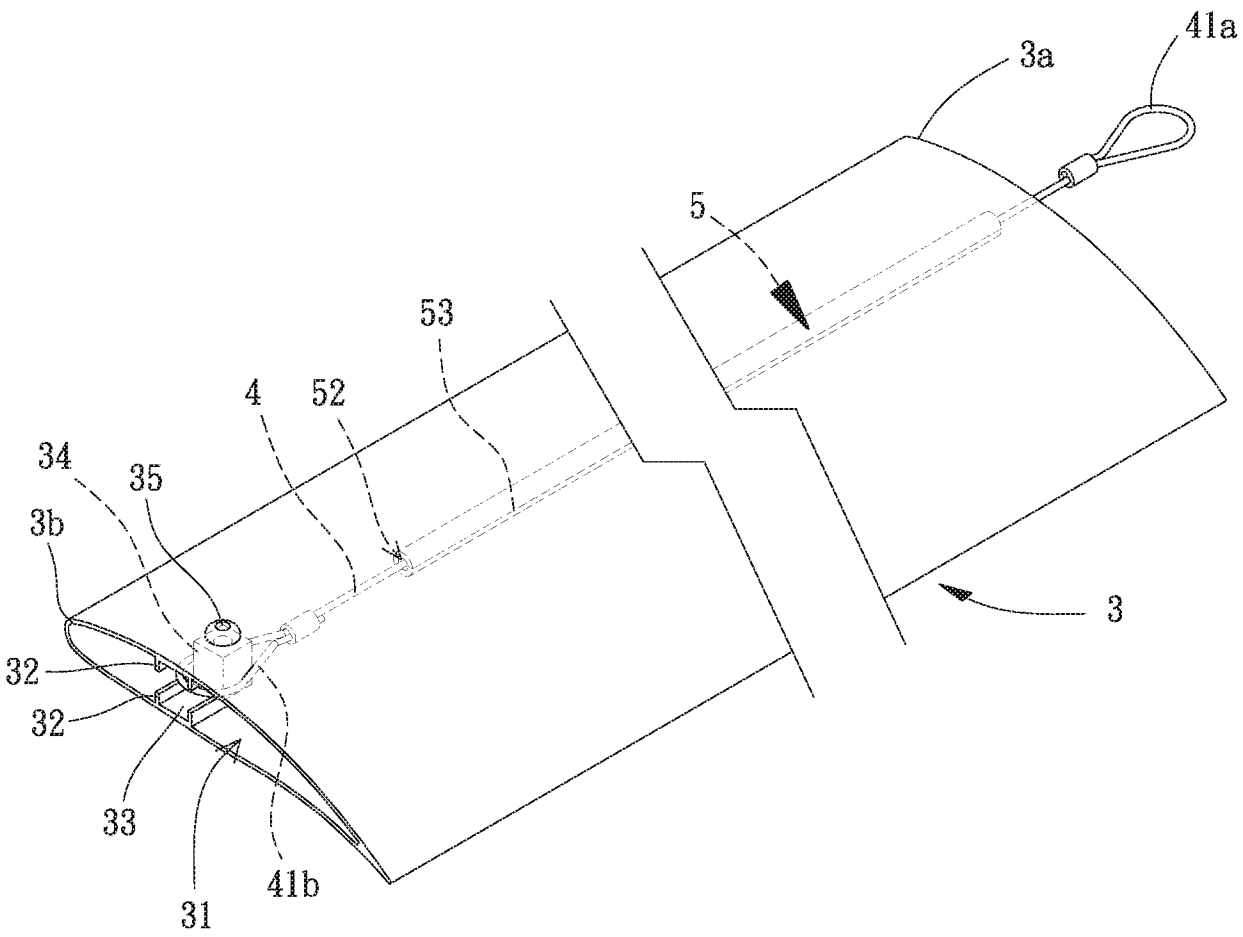
FIG. 4 is an assembled view of FIG. 3.

Referring to FIGS. 2, 3 and 4, each of two ends of the connecting member 4 preferably includes a hitching portion 41*a*, 41*b*. The hitching portion 41*a*, 41*b* is in an enclosed form and is hitched to the engagement member 21 of the hub 2, permitting the connecting member 4 to couple with the hub 2 via the engagement member 21. The hitching portion 41*b* is hitched to the block 34 of the blade 3 to improve the convenience and reliability in assembly thereof.

Figure 5:
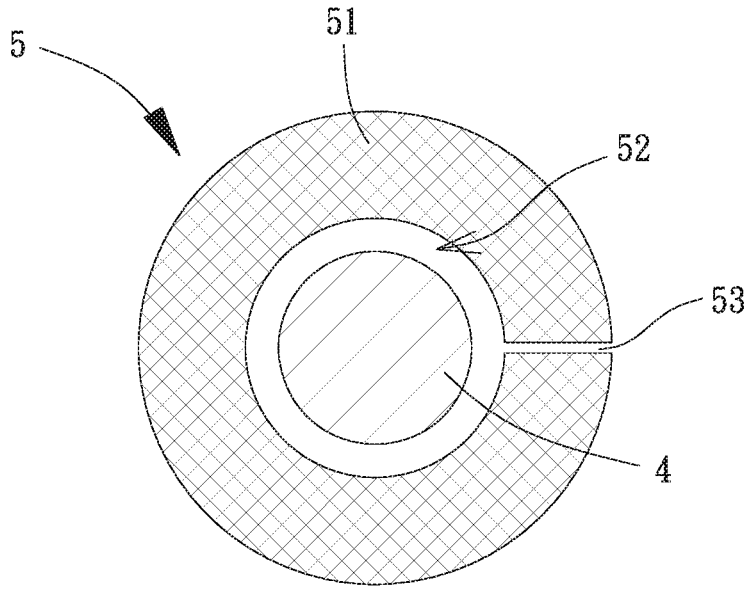
FIG. 5 is a cross sectional view of the connecting member and the protective sleeve according to the invention.

Referring to FIGS. 3 and 5, each of the plurality of protective sleeves 5 covers a respective connecting member 4 and comprises an elastic material or a foam material. Specifically, the cross section of each protective sleeve 5 is preferably in the form of a loop 51. The loop 51 may have a receiving hole 52 receiving the connecting member 4.

The loop 51 preferably has a slit 53 whose width is smaller than a diameter of the connecting member 4. Thus, the protective sleeve 5 can be assembled with the connecting member 4 more conveniently, improving the convenience in assembly of the protective sleeve 5 and the connecting member 4.

Figure 6:
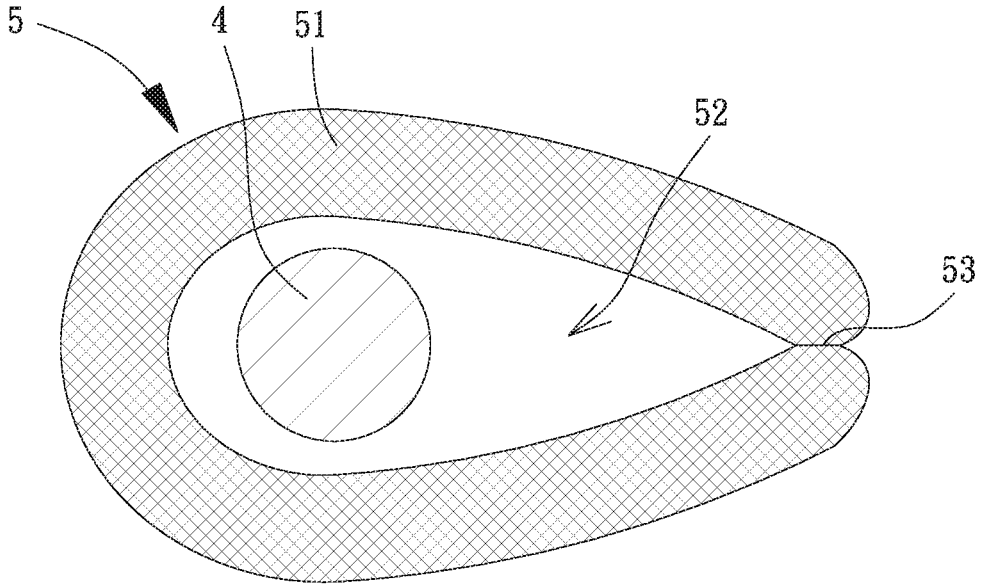
FIG. 6 is a cross sectional view of the connecting member and another type of the protective sleeve according to the invention.

It is noted that the loop 51 may be in the form of a circle as shown in FIG. 5 or in the form of a water droplet as shown in FIG. 6, to provide a better enclosing effect.

Referring to FIGS. 3 and 4, based on the above structure, each connecting member 4 is received in the channel 31 of a respective blade 3 while enveloped by the protective sleeve 5. In this arrangement, although the blade 3 collides with the connecting member 4 due to the vibration force resulting from the rotation of the ceiling fan, the arrangement of the protective sleeves 5 provides a vibration reduction effect between the blade 3 and the connecting member 4 while reducing the noise of the ceiling fan and making its appearance more appealing.

Besides, the connecting member 4 is connected between the hub 2 and the second end 3*b* of the blade 3. In this case, even though the blade 3 breaks somewhere around the second end 3*b*, the second end 3*b* of the blade 3 will not fall on the ground or fly apart. Advantageously, the safety in use is improved.

Based on the above, the ceiling fan according to the invention is provided with the plurality of connecting members respectively in the channels of the plurality of blades. In this regard, each of the plurality of connecting members is connected between the hub and the second end of a respective blade while being enveloped by a respective protective sleeve. As a result, the blade will not fall on the ground when the blade breaks or disengages from the hub. Also, the vibration or shaking noise caused by the connecting members resulting from the rotation of the ceiling fan can be reduced, thereby providing a low noise operation. Advantageously, the ceiling fan can serve as an air-driving apparatus which is useful, safe, and visually attractive.

Figure 7:
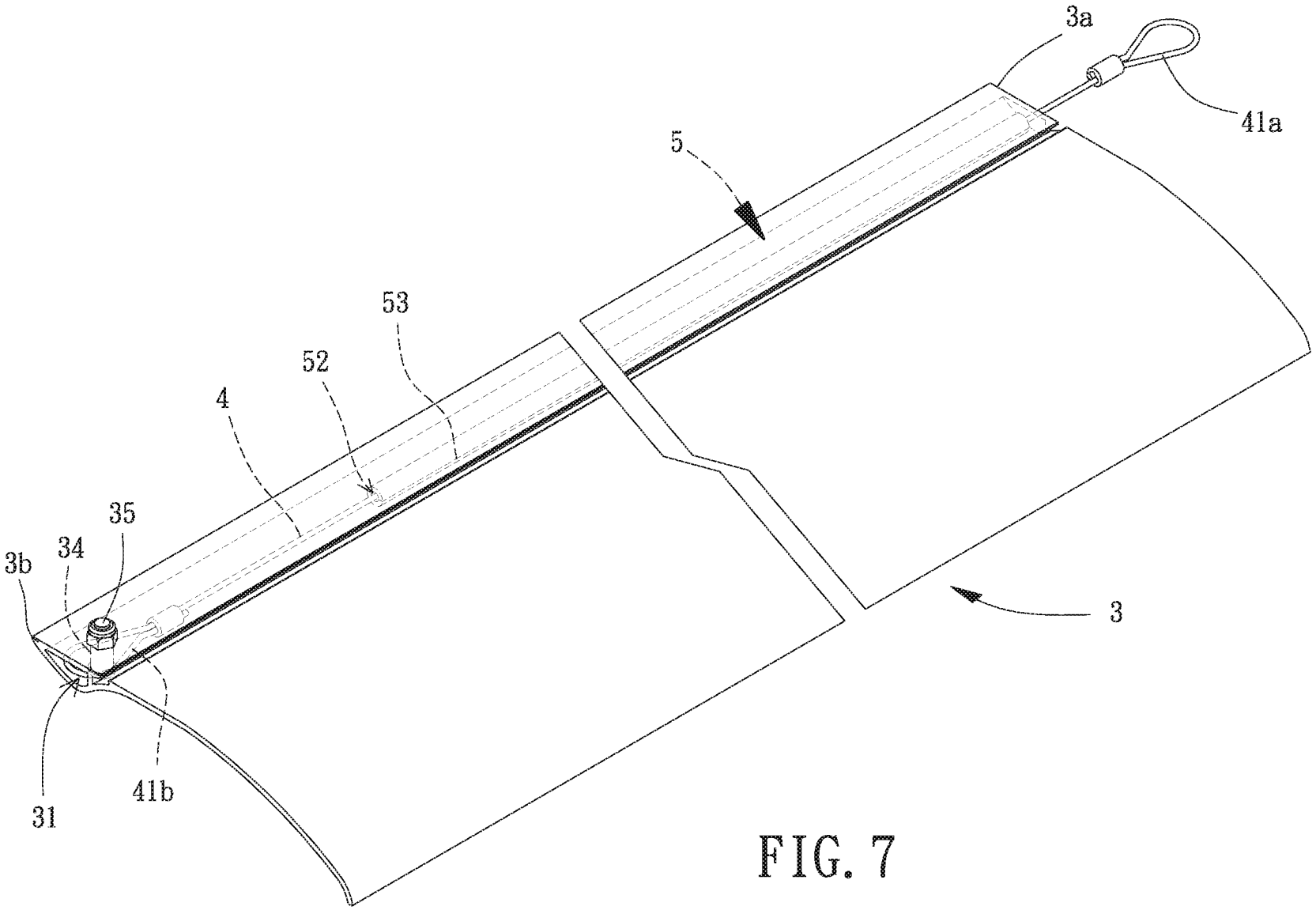
FIG. 7 shows the connecting member and the protective sleeve that are coupled with another type of blade according to the invention.

FIG. 7 shows another type of the blade 3 coupled with the connecting member 4 and the protective sleeve 5. This type of blade 3 is generally in the form of a thin plate but includes a hollow portion at one side of the blade 3.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A ceiling fan comprising:

an axle;

a hub rotatably coupled with the axle;

a plurality of blades coupled with the hub, wherein each of the plurality of blades has a first end and a second end, wherein the first end is coupled with the hub, and wherein each of the plurality of blades has a channel intercommunicating the first end with the second end;

a plurality of connecting members respectively received in the channels of the plurality of blades, wherein each of the plurality of connecting members has an end coupled with the hub, as well as another end coupled with the second end of the each of the plurality of blades; and a plurality of protective sleeves respectively enveloping the plurality of connecting members;

wherein each of the plurality of blades includes two ribs and a block in the channel thereof, the two ribs are aligned with each other in a vertical direction and form a seat at the second end of the each of the plurality of blades, the seat has a fixation space formed by inner wall surfaces of the two ribs, the block is connected to a respective one of the plurality of connecting members, and the block abuts the inner wall surfaces of the two ribs and is positioned in the fixation space of the seat.

2. The ceiling fan as claimed in claim 1, wherein each of the plurality of connecting members is in a form of a steel rope, a steel cable or a rope.

3. The ceiling fan as claimed in claim 1, wherein the two ribs are connected between the first end and the second end of the each of the plurality of blades.

4. The ceiling fan as claimed in claim 1, wherein each of the plurality of blades includes two limiting members and two limiting holes, wherein the two limiting holes are respectively arranged in a top face and a bottom face of the each of the plurality of blades in the vertical direction, wherein the block has a threaded hole axially aligned with the two limiting holes in the vertical direction, and wherein the two limiting members respectively extend through the two limiting holes and are threadedly engaged with the threaded hole.

5. The ceiling fan as claimed in claim 1, wherein each of the plurality of protective sleeves comprises an elastic material or a foam material.

6. The ceiling fan as claimed in claim 1, wherein the hub includes an intermediate member coupled with a top of the hub, and wherein the plurality of blades is coupled with the hub via the intermediate member.

7. The ceiling fan as claimed in claim 1, wherein a cross section of each of the plurality of protective sleeves is in a form of a loop, and wherein the loop has a receiving hole receiving a respective one of the plurality of connecting members.

8. The ceiling fan as claimed in claim 7, wherein the loop has a slit whose width is smaller than a diameter of each of the plurality of connecting members.

9. The ceiling fan as claimed in claim 7, wherein the loop is in a form of a water droplet.

* * * * *